US006572346B2

(12) United States Patent
Hsieh

(10) Patent No.: US 6,572,346 B2
(45) Date of Patent: Jun. 3, 2003

(54) COOLING FAN

(76) Inventor: Hsin-Mao Hsieh, No. 6, East Section, Chiao Nan Li, Industrial 6$^{th}$ Rd., Pingtung City, Pingtung Hsien (TW)

( * ) Notice: Subject to any disclaimer, the term of this patent is extended or adjusted under 35 U.S.C. 154(b) by 71 days.

(21) Appl. No.: 09/961,580

(22) Filed: Sep. 24, 2001

(65) Prior Publication Data

US 2003/0059318 A1 Mar. 27, 2003

(51) Int. Cl.$^{7}$ ..... F04B 17/00; F04B 35/04

(52) U.S. Cl. ..... 417/354; 310/68 R

(58) Field of Search ..... 417/354, 423.12, 417/32; 192/48.2; 310/68 R, 156.56, 71, 68 GB; 123/41.49; 165/80.3; 360/97.03; 361/699; 264/272.2

(56) References Cited

U.S. PATENT DOCUMENTS

| | | | | | |
|---|---|---|---|---|---|
| 4,734,015 | A | * | 3/1988 | Wrobel | 417/354 |
| 5,532,533 | A | * | 7/1996 | Mizutani | 310/68 B |
| 5,729,403 | A | * | 3/1998 | Schuh | 360/97.03 |
| 5,731,954 | A | * | 3/1998 | Cheon | 361/699 |
| 5,979,541 | A | * | 11/1999 | Saito | 165/80.3 |
| 6,136,250 | A | * | 10/2000 | Brown | 264/272.2 |
| 6,271,609 | B1 | * | 8/2001 | Hollenbeck et al. | 310/71 |
| 6,309,191 | B1 | * | 10/2001 | Hu | 417/423.12 |
| 6,360,703 | B1 | * | 3/2002 | Rahbar et al. | 123/41.49 |
| 6,429,566 | B1 | * | 8/2002 | Kuwahara | 310/156.56 |
| 6,488,475 | B2 | * | 12/2002 | Murata et al. | 417/32 |
| 2002/0024264 | A1 | * | 2/2002 | Matsumoto | 310/68 R |
| 2002/0046915 | A1 | * | 4/2002 | Inoue et al. | 192/48.2 |

FOREIGN PATENT DOCUMENTS

| | | | | |
|---|---|---|---|---|
| DE | 3153746 | * | 10/1991 | G11B/19/20 |
| FR | 898353 | * | 2/1999 | H02K/7/18 |

* cited by examiner

*Primary Examiner*—Teresa Walberg
*Assistant Examiner*—Leonid Fastovsky
(74) *Attorney, Agent, or Firm*—Alan D. Kamrath; Rider Bennett, LLP

(57) ABSTRACT

A cooling fan has a housing. A stator is securely mounted in the housing and has a coil, an upper pole sheet and a lower pole sheet coaxially provided at a top and a bottom of the coil respectively. A circuit board is provided beneath the lower pole sheet. An oil-retaining bearing is mounted in the stator. A rotator is received in the housing and has a cap covering the stator. A spindle is formed at the center of the cap and inserted through the oil-retaining bearing. A dust-proof disk is provided between the circuit board and the lower pole sheet and is received in the cap of the rotator. A gap between the circuit board and the cap is sealed by the dustproof disk, and dust will not enter into the rotator to block the oil-retaining bearing.

5 Claims, 5 Drawing Sheets

COOLING FAN

BACKGROUND OF THE INVENTION

1. Field of the Invention

The present invention is related to a cooling fan, and more particularly to a dustproof cooling fan.

2. Description of Related Art

A micro cooling fan is generally assembled on an electronic element which will generate a lot of heat, such as a CPU or a video-display adapter etc., to reduce the temperature of the element. With reference to FIG. 5, a conventional cooling fan has a housing (50), a stator (52) and a rotator (60) coaxially received in the housing (50).

The housing (50) has a bottom plate (51) and a flange (511) with an opening formed at the center of the bottom plate (51). The stator (52) has a sleeve (53) inserted through the opening in the flange (511). An upper pole sheet (54), a coil (55), a lower pole sheet (56) and a circuit board (57) are in turn and coaxially provided outside the sleeve (53). An oil-retaining bearing (58) is provided in the sleeve (53).

The rotator (60) has a cap (61) covering the stator (52). A ring-like permanent magnet (63) is secured on an inner wall of the cap (61) and a bushing (62) is provided between the permanent magnet (63) and the cap (61). A spindle (64) is formed at the center of the cap (61) and inserted into the oil-retaining bearing (58). A plurality of blades (not numbered) is radially formed on an outer periphery of the cap (61).

In operating, the oil-retaining bearing (58) will emit oil to lubricate the spindle (64). However, there is a gap (D) between the circuit board (57) and the cap (61), by which dust can enter into the sleeve (53) and accumulate on the oil-retaining bearing (58) and the spindle (64). The accumulated dust blocks the oil-retaining bearing (58) and the oil in the bearing (58) cannot emit out. In this case, the spindle (64) will not rotate smoothly and may even be stopped.

Therefore, the invention provides an improved cooling fan to mitigate and/or obviate the aforementioned problem.

SUMMARY OF THE INVENTION

The main objective of the invention is to provide a cooling fan which can prevent dust from entering into an oil-retaining bearing.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
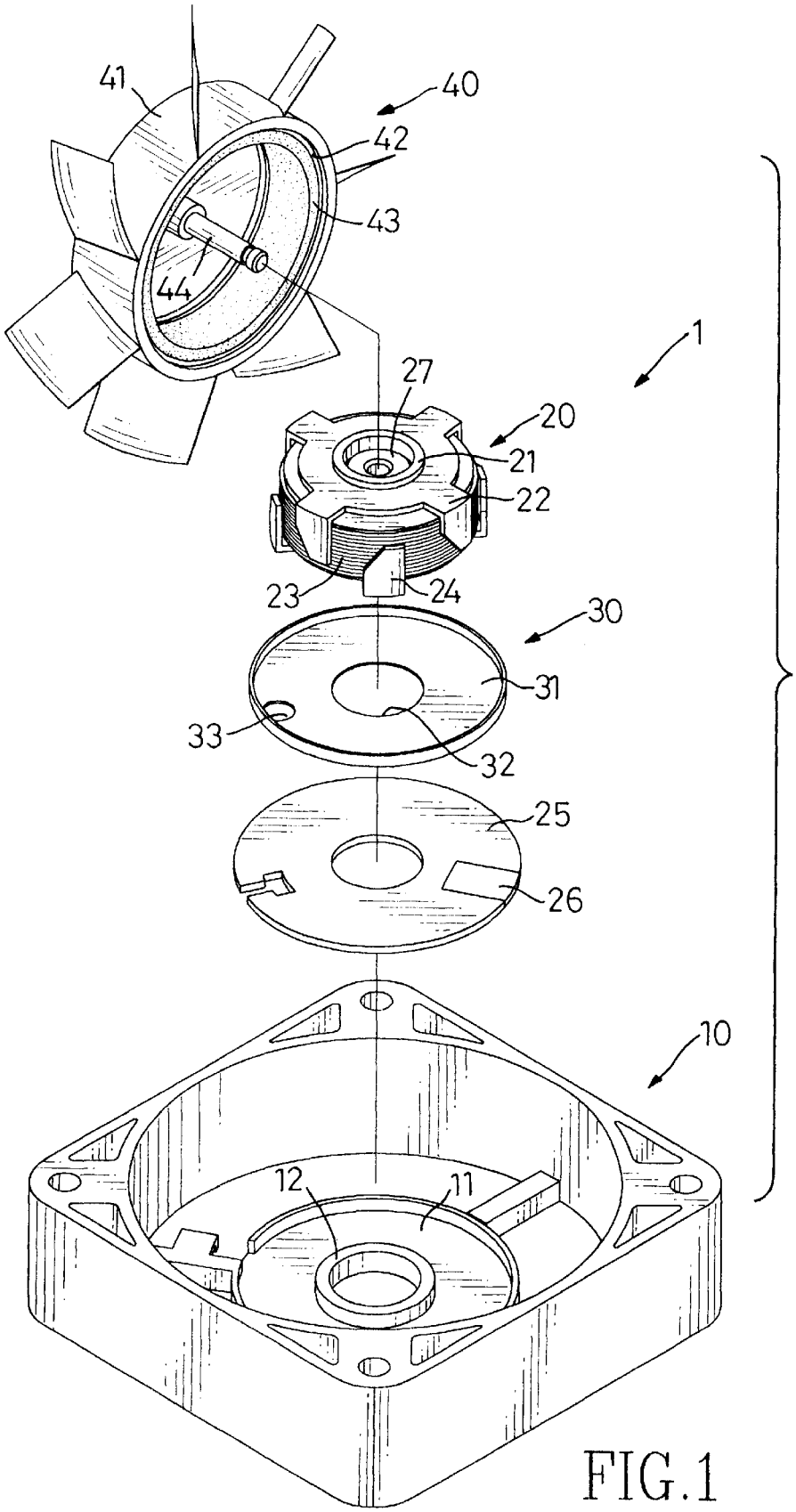
FIG. 1 is an exploded perspective view of a cooling fan in accordance with the invention.
Figure 2:
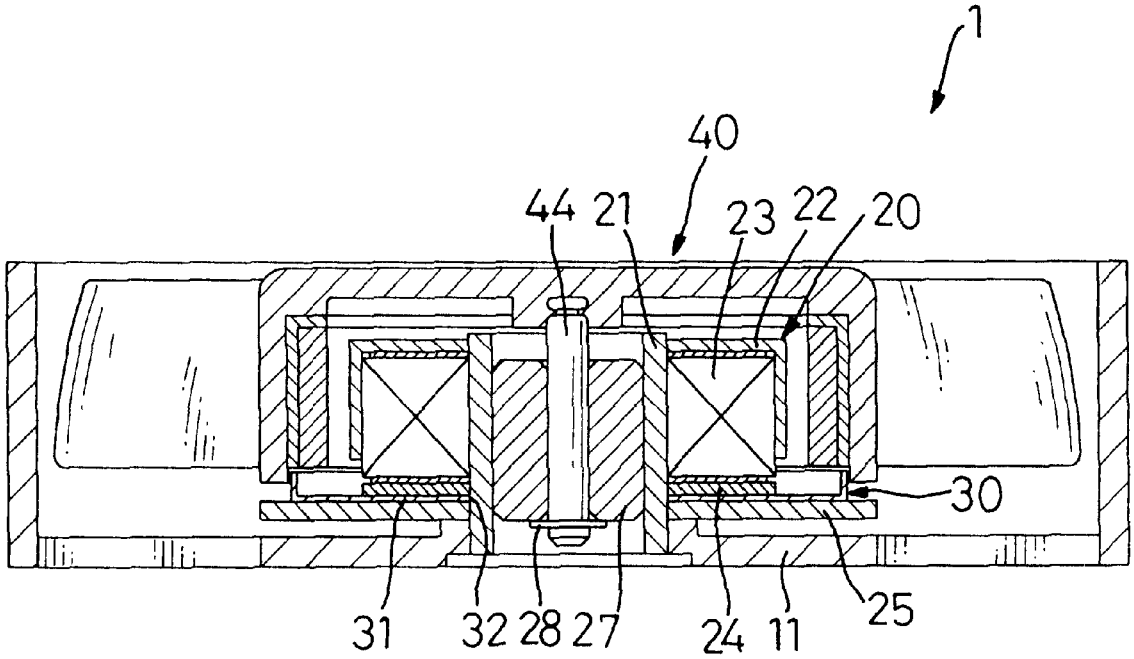
FIG. 2 is a cross sectional view of the cooling fan in FIG. 1.

Referring to FIGS. 1 and 2, a cooling fan (1) in accordance with the present invention has a housing (10). The housing (10) has a bottom plate (11) and a flange (12) formed at the center of the bottom plate (11). An opening (not numbered) is defined through the flange (12).

A stator (20) is securely mounted in the housing (10) and has a sleeve (21) inserted in the opening of the flange (12). A coil (23) is provided outside the sleeve (21). An upper pole sheet (22) and a lower pole sheet (24) are provided outside the sleeve (21) and coaxially mounted at a top and a bottom of the coil (23) respectively. A circuit board (25) is also provided outside the sleeve (21) and beneath the lower pole sheet (24) and has an inductive element (26) mounted thereon. An oil-retaining bearing (27) is received in the sleeve (21).

A rotator (40) is also received in the housing (10) and has a cap (41) covering the stator (20). A ring-like permanent magnet (43) is secured on an inner wall of the cap (41). A bushing (42) is provided between the cap (41) and the permanent magnet (43). A spindle (44) is formed at the center of the cap (41) and inserted through the oil-retaining bearing (27) and secured by a collar (28). A plurality of blades (not numbered) is radially formed on an outer periphery of the cap (41).

An improvement of the present invention is a dustproof disk (30) provided between the circuit board (26) and the lower pole sheet (24) and received in the cap (41). The dustproof disk (30) has a body (31) and a hole (32) defined at the center of the body (31). The sleeve (21) is extended through the hole (32). A skirt (not numbered) is formed at an outer circumference of the body (31), and extends upward and is substantially aligned with the bushing (42) to seal a gap between the circuit board (25) and the cap (41). An aperture (33) is defined near the outer circumference of the dustproof disk (30) for wires (not shown or numbered) of the coil (23) to extend therethrough.

Figure 3:
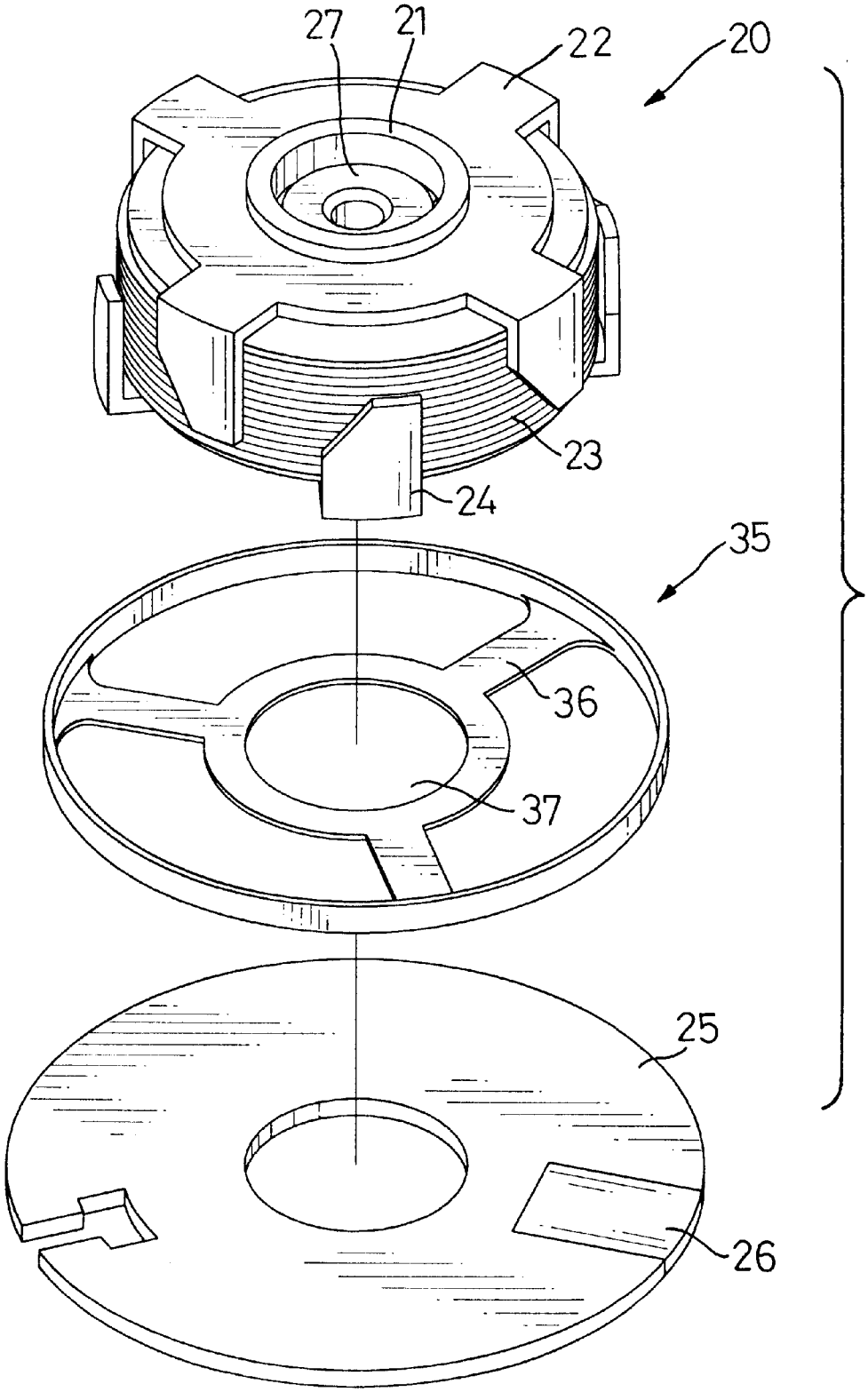
FIG. 3 is an exploded perspective view of parts of another embodiment of a cooling fan in accordance with the invention.
Figure 4:
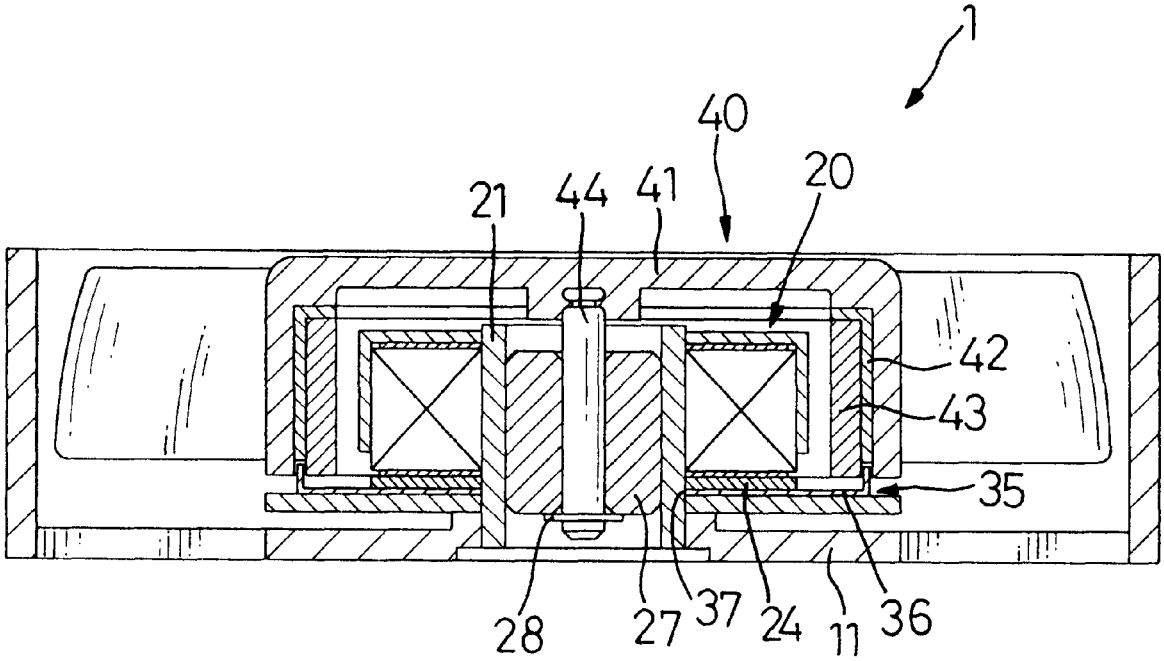
FIG. 4 is a cross sectional view of the embodiment of the cooling fan in FIG. 3.
Figure 5:
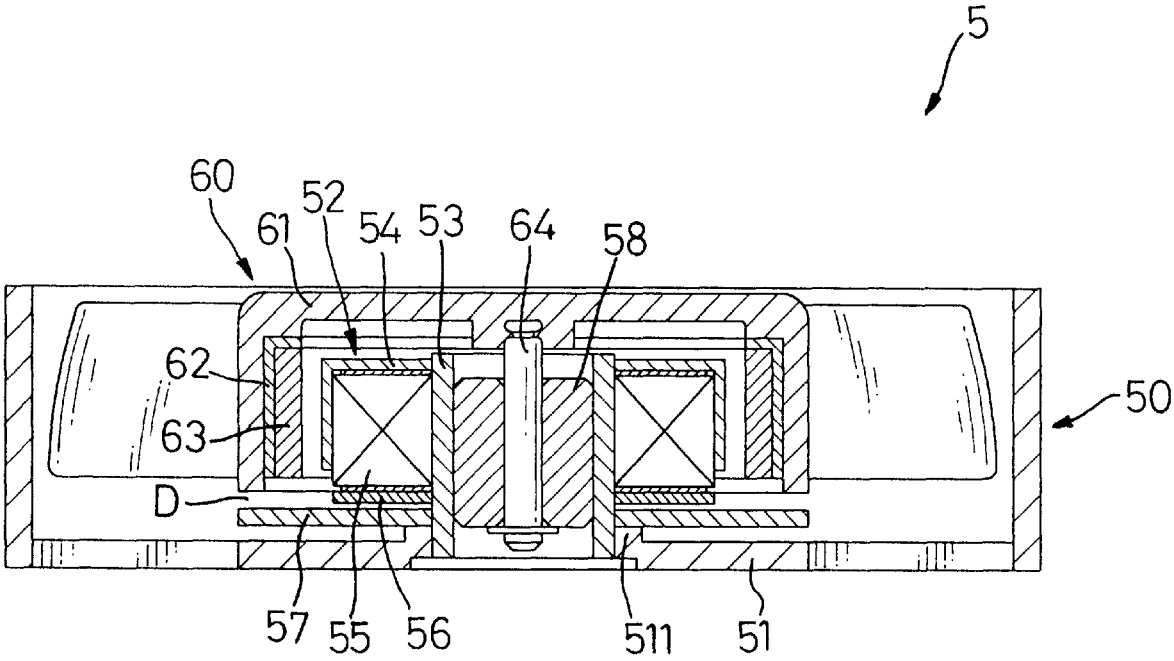
FIG.5 PRIOR ART
FIG. 5 is a cross sectional view of a conventional cooling fan.

With reference to FIGS. 3 and 4, in a second embodiment of the invention, another dustproof disk (35) has a big ring (not numbered) substantially aligned with the bushing (42) to seal the gap between the circuit board (25) and the cap (41). A small ring (also not numbered) with a hole (37) is formed at the center of the big ring. The sleeve (21) is extended through the holed (37). A plurality of spokes (36) is radially connected between the big ring and the small ring. The wires of the coil can extend through notches between these spokes (36).

By the dustproof disk (30 or 35) provided between the circuit board (25) and the lower pole sheet (24), the gap between the circuit board (25) and the cap (41) is sealed and dust can not enter into the rotator (40) whereby the oil-retaining bearing (27) will remain clean. Thus, the spindle (44) rotates smoothly and the cooling fan (1) will have a long useful life.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cooling fan comprising:

a housing (10), the housing (10) having a bottom plate (11) and a flange (12) with an opening formed at the center of the bottom plate (11);

a stator (20) received in the housing (10) and securely mounted on the flange (12), the stator (20) having a sleeve (21) inserted in the opening of the flange (12), a coil (22) provided outside the sleeve (21), an upper pole sheet (22) and a lower pole sheet (24) provided outside the sleeve (21) and at a top and a bottom of the coil (22) respectively and coaxial with the coil (22), a circuit board (25) provided outside the sleeve (21) and beneath the lower pole sheet (24), and an oil-retaining bearing (28) inserted in the sleeve (21);

a rotator (40) received in the housing (10), the rotator (40) having a cap (41) covering the stator (20), a ring-like permanent magnet (43) secured on an inner wall of the cap (41), a bushing (42) provided between the cap (41) and the permanent magnet (43), a spindle (44) formed at the center of the cap (41) and inserted through the oil-retaining bearing (27) and secured by a collar (28); and a dustproof disk provided outside the sleeve (21) and between the circuit board (25) and the lower pole sheet (24) and received in the cap (41) of the rotator (40), whereby, a gap between the circuit board (25) and the cap (41) is sealed by the dustproof disk such that dust will not enter into the inside of the rotator (40).

2. The cooling fan as claimed in claim 1, wherein the dustproof disk (30) has a body (31), a hole (32) defined at the center of the body (31) for the sleeve (21) extending through the hole (32), a skirt formed at an outer circumference of the dustproof disk (30) and extending upward to seal a gap between the circuit board (25) and the cap (41), and an aperture (33) defined near the outer circumference of the dustproof disk (30) for wires to extend through the aperture (33).

3. The cooling fan as claimed in claim 2, wherein the skirt is substantially aligned with the bushing (42).

4. The cooling fan as claimed in claim 1, wherein the dustproof disk (35) has a big ring to seal the gap between the circuit board (25) and the cap (41), a small ring with a hole (37) formed at the center of the big ring for the sleeve (21) to extend through the hole (37); and a plurality of spokes (36) radially connected between the big ring and the small ring.

5. The cooling fan as claimed in claim 4, wherein the big ring is substantially aligned with the bushing (42).

* * * * *